United States Patent [19]

Smith

[11] 4,154,360

[45] May 15, 1979

[54] OVERCAP AND CONTAINER ASSEMBLY

[75] Inventor: Ernest L. Smith, Kansas City, Mo.

[73] Assignee: Phillips Petroleum Company, Bartlesville, Okla.

[21] Appl. No.: 926,599

[22] Filed: Jul. 21, 1978

[51] Int. Cl.[2] ..... B65D 51/22

[52] U.S. Cl. ..... 220/258; 220/380; 220/359; 229/43; 206/503; 206/520

[58] Field of Search ..... 220/256, 257, 258, 306, 220/380, 359; 229/43, 5.8, 5.7, 5.5; 215/232, 352, 350; 206/503, 520; 150/0.5

[56] References Cited

U.S. PATENT DOCUMENTS

| | | | |
|---|---|---|---|
| 3,178,051 | 4/1965 | Edwards | 220/380 |
| 3,805,993 | 4/1974 | Enzie et al. | 220/258 |
| 3,892,351 | 7/1975 | Johnson et al. | 229/43 |
| 3,973,719 | 8/1976 | Johnson et al. | 220/359 X |
| 4,044,941 | 8/1977 | Knudeen | 229/43 |
| 4,076,123 | 2/1978 | Davis | 206/503 |
| 4,094,460 | 6/1978 | Scanga et al. | 220/258 |

*Primary Examiner*—George T. Hall

[57] ABSTRACT

A container assembly comprising a container, a membrane closure, and an overcap wherein the membrane closure acts to restrain removal of the overcap. Also disclosed is a novel overcap especially suitable for forming such a container assembly.

18 Claims, 5 Drawing Figures

OVERCAP AND CONTAINER ASSEMBLY

The present invention relates to containers, particularly containers which are sealed with a membrane closure. The present invention also relates to plastic overcaps which protect the membrane closure and which can be used to reseal such containers after the membrane closure has been removed.

It has become quite common in the packaging field to distribute materials in containers having the upper end sealed by a relatively thin membrane closure formed of metal, plastic, paper etc. It is also quite common to employ with such containers overcaps which fit over the membrane closure to protect the seal from being accidentally broken. The overcaps are also generally suitable for use on a top closure after the membrane closure has been removed.

Generally these prior art containers have an outwardly disposed rim or lip over which a portion of the overcap snaps so as to inhibit the overcap from being accidentally displaced. If the container has no outwardly dispersed rim or such and the sidewall of the container is generally cylindrical from the upper end downward at least to the point where the overcap contacts the sidewall, overcaps tend to be too easily displaced.

Accordingly, it is an object of this invention to provide a container assembly wherein the container has no outwardly dispersed rim, or such, and yet the overcap is reasonably resistant to accidental displacement.

Another object of the instant invention is to provide an overcap especially suitable for forming such a container assembly.

Still other apsects and objects of the present invention will be apparent from the following description and the accompanying drawings.

In accordance with the present invention there is provided a container assembly comprising a container, a membrane closure, and a overcap. The container has an opening in its upper end and a sidewall which is generally cylindrical on the exterior from the upper end of the container downward to at least the lowest point where the overcap contacts the sidewall of the container. The membrane closure covers the opening in the upper end of the container and extends beyond the outside diameter of the upper end of the container. The overcap comprises (1) a top surface overlying the membrane closure and the upper end of the container and (2) a downwardly depending skirt having an inwardly directed rib means which contacts the exterior of the sidewall of the container at a point below the peripheral edge of the membrane closure.

The container of the inventive container assembly can be constructed of any suitable material. In a preferred embodiment all the cross sections taken perpendicular to the longitudinal axis of the container are generally circular on the exterior and substantially the same diameter; and the container is formed from paperboard or the like. In an especially preferred embodiment the upper end of the paperboard sidewall of the container has a circumferential rim formed by an inwardly disposed portion of the sidewall. Methods of forming such paperboard containers are known in the art. One particularly preferred well known method involves forming the sidewall from a block of generally rectangular paperboard.

The bottom closure of the container can be provided by any suitable means. In a particularly preferred embodiment where the sidewall and the bottom closure are both formed of paperboard, the bottom closure comprises a generally circular disk having a depending skirt which is crimped inwardly with the bottom edge of the sidewall to form a crimped seal. An example of such a bottom closure is disclosed in U.S. Pat. No. 3,944,126, the disclosure of which is incorporated herein by reference.

The membrane closure of the inventive container assembly can be constructed of any of the materials generally used for membrane closures. It is to be noted that the more flexible the membrane material the more likely it is that the overcap be accidentally displaced. Generally it is preferred that the membrane closure be bonded to the upper end of the container to seal the opening therein. The membrane closure can be bonded to the container in any suitable manner known in the art. A suitable membrane material is paper coated on one or both sides with polyethylene. Another suitable material is aluminum foil coated on one or both sides with polyethylene.

Preferably the membrane closure is of sufficient size that when the overcap is applied the membrane closure will extend downward alongside a portion of the sidewall of the upper end of the container. Such an arrangement generally results in rendering the overcap much less susceptible to accidental displacement than arrangements in which the membrane merely extends outward beyond the outer circumference of the upper end of the container.

The overcap can be constructed of any suitable material. In a preferred embodiment the overcap is molded from a plastic such as polyethylene. Another suitable material is polystyrene. Preferably the overcap is sufficiently flexible that it can be removed from the container without removing the membrane closure.

In accordance with another aspect of the instant invention there is provided a particular type of overcap especially suitable for use in a container assembly of the type herein described. The inventive overcap comprises a circular top surface having a skirt depending downwardly from the periphery of the top surface. The skirt comprises a first wall portion extending downwardly from the periphery of the top surface. The internal diameter of the first wall portion is at least as large as the sum of the dimension of the upper end of the container to which it is to be applied plus the dimension of two thicknesses of the membrane closure that is to be used on the container. The skirt further comprises a first step portion extending outward from said first wall portion, a second wall portion extending downwardly from the periphery of the first step portion such that said second wall portion has a larger internal diameter than the first wall portion, an inwardly directed rib comprising a third wall portion depending downwardly and inwardly from the lowermost portion of the second wall portion such that the lowermost portion of the third wall portion contacts the exterior of the confirming container when said overcap is secured in said container, a fourth wall portion depending downwardy and outwardly from the lowermost portion of said third wall portion such that when one said overcap is placed upon another like overcap in a stacked relationship the lower surface of the fourth wall portion of the upper overcap will rest upon the top surface of the lower overcap. The rib of the above described skirt is spaced apart from the top surface of the overcap such that, when the overcap is secured on a container having a suitable membrane closure, the periphery of the membrane closure will be in a position between said top surface and said rib. A further understanding of the instant invention will be provided by referring to the attached drawings which illustrate a preferred embodiment of the instant invention.

In the drawings:

FIG. 4 also illustrates how another like container can be stacked upon the inventive container assembly.

In the drawings the numerals refer to like parts wherever they occur.

Figure 1:
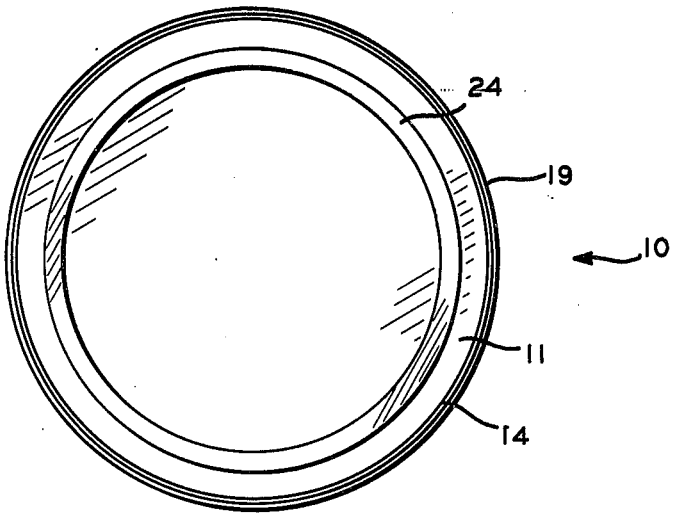
FIG. 1 is a top plan view of an overcap embodying features of the instant invention.

Now referring to the drawings in detail, there is illustrated in FIG. 1 an inventive overcap 10. The overcap as shown more clearly in cross section in FIG. 4 includes a top surface 11 and a skirt 12 depending downwardly from the periphery of the top surface 11. The skirt 12 comprises a first wall portion 13 extending downwardly from the periphery of the top surface generally at a right angle thereto, a first step portion 14 extending outwardly from the first wall portion 13, generally at a right angle thereto, a second wall portion 15 extending downwardly from the periphery of the first step portion 14 generally at a right angle thereto, a third wall portion 16 depending downwardly and inwardly from the lowermost portion of the second wall portion 15 at an angle of about 120° relative to the second wall portion, a fourth wall portion 17 depending downwardly and outwardly from the lowermost portion of the third wall portion 16 at an angle of about 10° relative to a plane that is parallel to that of the second wall portion which plane intersects the inner most portion of the third wall portion, a second step portion 18 extending outwardly from the lowermost portion of the fourth wall portion 17, and a fifth wall portion 19 extending downwardly and outwardly from the periphery of the second step portion 18 at an angle of about 93° relative to the second step portion. The overcap 10 further includes on the inner surface of the fourth wall portion 17 a plurality of circumferentially spaced-apart inwardly directed projections 20. The outer surface of the fourth wall portion 17 also includes outwardly opening indentations 21 conforming to the respective projections 20. The rib defined by the third wall portion 16 and the fourth wall portion 17 also includes a plurality of circumferentially spaced-apart inwardly opening venting indentations 22. The exterior of the skirt 12 further includes outwardly directed projections 23 conforming to the respective venting indentations 22. It is further pointed out that the top surface 11 includes an upwardly extending rib 24.

Figure 2:
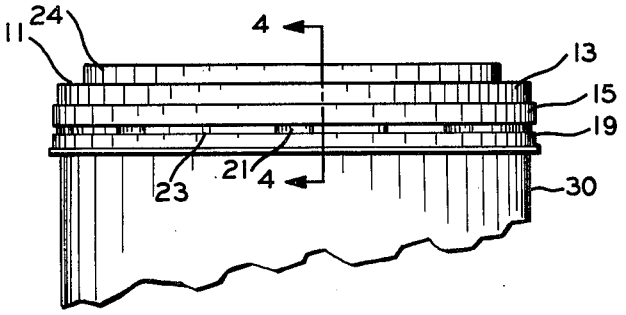
FIG. 2 is a side elevation view of the overcap of FIG. 1 placed upon a container.
Figure 3:
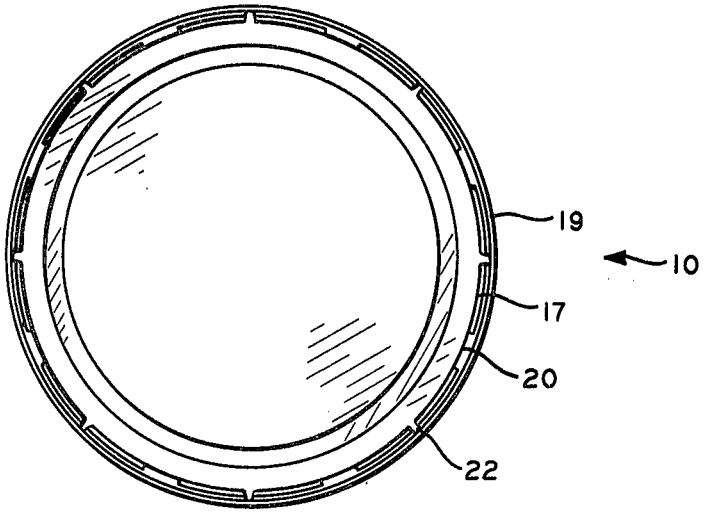
FIG. 3 is a bottom plan view of the overcap of FIG. 1.
Figure 4:
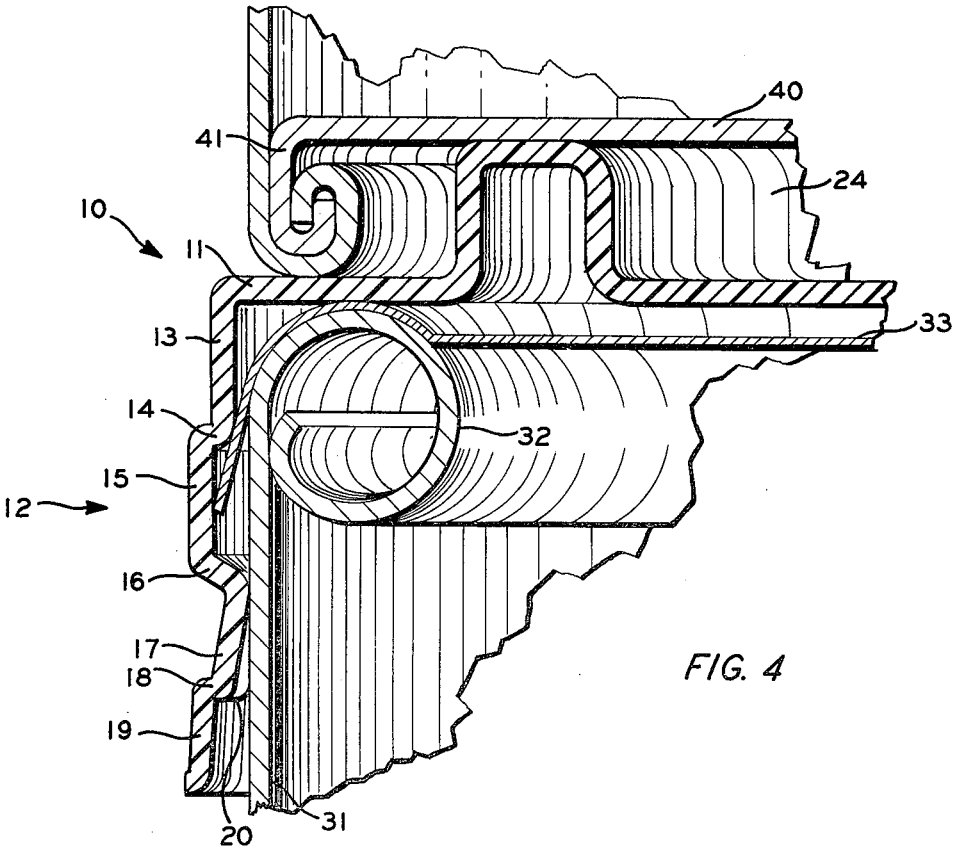
FIG. 4 is an enlarged fragmentary vertical section view of an inventive container assembly employing the overcap of FIG. 1.

FIGS. 2 and 4 illustrate the overcap 10 of FIG. 1 placed upon a container 30. The container assembly can be seen in more detail in FIG. 4. As there illustrated the container 30 comprises a generally cylindrical sidewall 31. The upper end of the sidewall has been rolled inwardly to provide an inwardly extending rim 32. Adhered to the inwardly extending rim 32 is a membrane closure 33. Finally the overcap 10 rests upon the membrane closure 33.

In the illustrated embodiment it will be noted that the membrane closure 33 is sufficiently large that it extends downward alongside the outer surface of the container sidewall 31 to a point where its periphery is somewhere between the first step portion 14 and the junction of the third wall portion 16 and the second wall portion 15 of the overcap. The third wall portion 16 of the overcap extends inwardly such that it contacts the exterior sidewall 31. Since the membrane closure 33 extends beyond the outer surface of the container 30, if the overcap is subjected to a displacing force the periphery of the membrane closure will contact the inner surface of the third wall portion 16 of the skirt to inhibit the displacement of the overcap.

The indentations 21 on the fourth wall portion 17 of the overcap also extend inwardly to contact the exterior of the sidewall. These indentations serve the purpose of providing additional friction to aid in keeping the overcap from being accidentally displaced when the overcap is used for resealing the container after the membrane closure has been removed.

The venting indentations 22 provide the space surrounding the container sidewall above the third wall portion of the overcap with access to the atmosphere. In the absence of such venting indentations, it is noted that when one attempts to remove the overcap from the container a vacuum tends to be formed in the area above the third wall which tends to inhibit the ease of intentional opening of the container. It should be noted that while such venting indentations are not absolutely necessary they do provide a useful effect.

The rib 24 on the top surface of the overcap is constructed such that it will fit inside the sidewall of the bottom of a superimposed conforming container as illustrated in FIG. 4.

In preferred embodiments the container 10 has a bottom structure such as that illustrated for the container stacked upon the overcap of the container assembly illustrated in FIG. 4. That bottom structure comprises a generally circular disk 40 having a downwardly depending skirt 41 that is secured to the container by an inwardly crimped portion of the bottom edge of the container sidewall 10.

Figure 5:
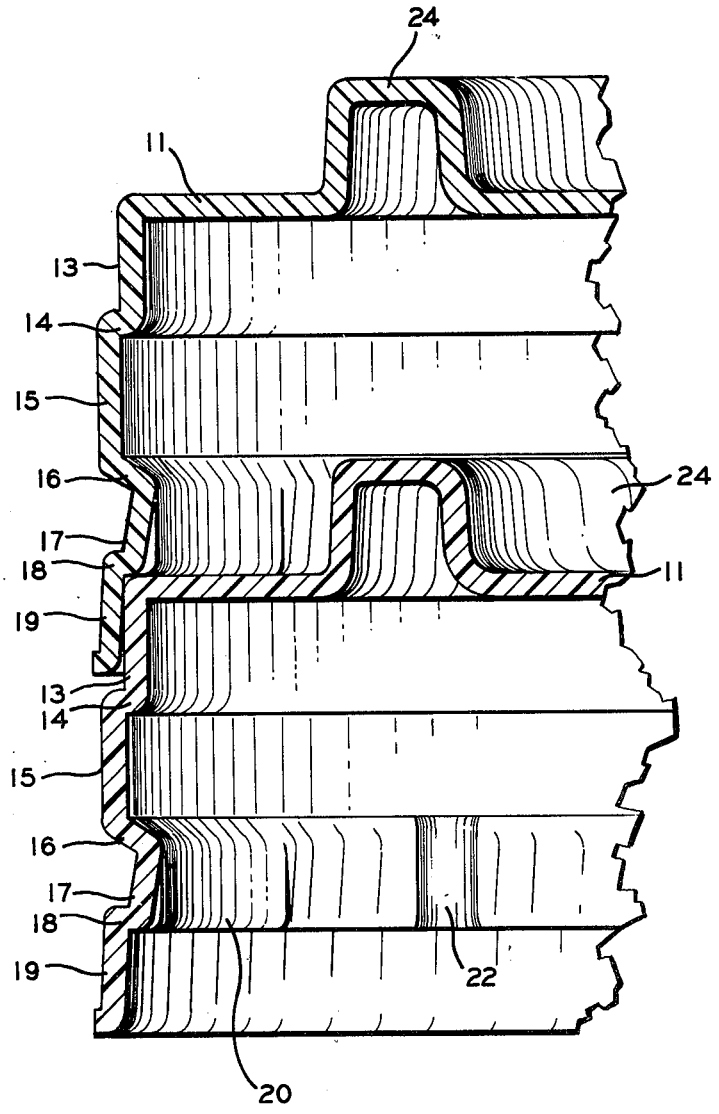
FIG. 5 is an enlarged fragmentary vertical section view showing a stack of two overcaps as illustrated in FIG. 1.

FIG. 5 illustrates how the structure of the overcap of FIG. 1 serves to permit stacking of such overcaps. As shown in FIG. 5, when two such overcaps as stacked the lower surface of the fourth wall portion 17 of the upper overcap rests upon the top surface of the lower overcap. The second step portion 18 and the fifth wall portion 19 are constructed such that the fifth wall portion 19 of the upper container extends down and around the first wall portion 13 of the lower overcap.

From the foregoing description one skilled in the art can easily ascertain the essential characteristics of this invention and without departing from the spirit and scope thereof, can make various changes and modifications of the invention to adapt it to various usages and conditions. Accordingly, it is noted that while the invention has been described in regard to a particular preferred embodiment, it is noted that the invention is not limited thereto. It is intended to include within the scope of the claims all embodiments which employ the benefit of the essence of this invention.

I claim:

1. An overcap for a container having an opening in its upper end, a sidewall cylindrical on the exterior from the upper end downward at least to the point where said overcap contacts said sidewall when said overcap is secured in said container, and a membrane closure covering said opening and extending beyond the outside diameter of the upper end of said container, said overcap comprising a circular top surface having a skirt depending downwardly from the periphery of said top surface, wherein said skirt comprises a first wall portion extending downwardly from the periphery of said top surface and having an internal diameter at least as large as the sum of the dimension of the exterior of the upper end of said container plus the dimension of two thicknesses of the membrane closure, a first step portion extending outwardly from first wall portion, a second wall portion extending downwardly from the periphery of said first step portion such that said second wall portion has a larger internal diameter than said first wall portion, an inwardly directed rib comprising a third wall portion depending downwardly and inwardly from the lowermost portion of said second wall portion such that the lowermost portion of said third wall portion contacts the exterior of said container when said overcap is secured in said container, a fourth wall portion depending downwardly and outwardly from the lowermost portion of said third wall portion such that when one said overcap is placed upon another like overcap in a stacked relationship the lower surface of said fourth wall portion of the upper overcap will rest upon the top surface of the lower overcap, and wherein said rib is spaced apart from said top surface such that when said overcap is secured on said container such that the bottom of said top surface contacts the top of said container the periphery of said membrane closure will be in a position between said top surface and said rib.

2. An overcap according to claim 1 wherein said fourth wall on its inner surface includes a plurality of circumferentially spaced- apart inwardly directed projections, which contact the exterior of said container when said overcap is secured thereto.

3. An overcap according to claim 2 having a second step portion extending outwardly from the lowermost portion of said fourth wall portion and a fifth wall portion extending downwardly from the periphery of said second step portion, wherein said second step portion and said fifth wall portion are such that when one such overcap is placed upon another such overcap in a stacked relationship the fifth wall portion of the upper closure will circumferentially surround the first wall portion of the lower overcap at least part way down said first wall portion.

4. An overcap according to claim 3 wherein said rib includes on its inner surface at least one inwardly opening venting indentation.

5. An overcap according to claim 4 wherein said top surface includes an upwardly extending rib concentric with and inwardly disposed to the perimeter of said top surface wherein the diameter of said rib is such as to fit inside the sidewall of the bottom of a superimposed conforming container to act as a stacking seat for said superimposed container.

6. An overcap according to claim 4 wherein said third wall portion inclines inwardly at about 120° relative to said second wall portion and wherein said fourth wall portion inclines outwardly at about 10° relative to a plane that is parallel to that of said second wall and that intersects the innermost portion of said third wall portion.

7. An overcap according to claim 6 wherein said fifth wall portion extends outwardly about 93° relative to said second step portion.

8. A container assembly comprising a container, a membrane closure, and an overcap, wherein said container has an opening in its upper end and a sidewall which is generally cylindrical on the exterior from the upper end of the container downward to at least the lowest point where said overcap contacts the sidewall of said container, wherein said membrane closure covers the opening in said container and extends beyond the outside diameter of the upper end of said container, and wherein said overcap comprises (1) a top surface overlying that membrane closure and the upper end of said container and (2) a downwardly depending skirt having an inwardly directed rib means which contacts the exterior of the sidewall of said container below the peripheral edge of said membrane closure.

9. A container assembly according to claim 8 wherein said membrane closure extends downwardly alongside a portion of the sidewall of the upper end of said container.

10. A container assembly according to claim 9 wherein the exterior of said container is of a uniform circular cross-section, wherein said container sidewall is formed of paperboard or the like and wherein the upper end of said sidewall comprises a circumferential rim formed by an inwardly disposed portion of the sidewall.

11. A container assembly according to claim 10 wherein said overcap comprises a circular top surface having a skirt depending downwardly from the periphery of said top surface, wherein said skirt comprises a first wall portion extending downwardly from the periphery of said top surface and having an internal diameter at least as large as the sum of the dimension of the exterior of the upper end of said container plus the dimension of two thickness of the membrane clause, a first step portion extending outwardly from said first wall portion, a second wall portion extending downwardly from the periphery of said first step portion such that said second wall portion has a larger internal diameter than said first wall portion, an inwardly directed rib comprising a third wall portion depending downwardly and inwardly from the lower most portion of said second wall portion such that the lowermost portion of said third wall portion contacts the exterior of said container, a fourth wall portion depending downwardly and outwardly from the lowermost portion of said third wall portion such that when one such overcap is placed upon another such overcap is a stacked relationship the lower surface of said fourth wall portion of the upper overcap will rest upon the top surface of the lower overcap, and wherein said rib is spaced apart from said top surface such that the periphery of the membrane closure is in a position between said top surface and said rib.

12. A container assembly according to claim 11 wherein the fourth wall of said overcap has on its inner surface a plurality of spaced-apart inwardly directed projections which contact the exterior of said container.

13. A container assembly according to claim 12 wherein said rib includes on its inner surface a plurality of circumferentially spaced-apart inwardly opening venting indentations.

14. A container assembly according to claim 13 wherein said container includes a bottom closure comprising a generally circular disk having a depending skirt which is secured to the container by an inwardly crimped portion of the bottom edge of the container sidewall.

15. A container assembly according to claim 14 wherein said overcap includes on its top surface an upwardly extending rib concentric with and inwardly disposed to the perimeter of said top surface wherein the diameter of said rib is such as to fit inside the bottom of the sidewall of a superimposed like container.

16. A container assembly according to claim 15 wherein said upwardly extending rib is of such height that when a like container is stacked upon said overcap the bottom of the sidewall of said like container can rest upon the portion of the top surface of said overcap that lies outside said upwardly extending rib.

17. A container assembly according to claim 13 wherein said membrane closure extends downward alongside the outer surface of the container sidewall to a point where the periphery of the membrane closure is somewhere between the first step portion and the junction of the third wall portion and the second wall portion of the overcap.

18. A container assembly according to claim 11 wherein said membrane closure extends downward alongside the outer surface of the container sidewall to a point where the periphery of the membrane closure is somewhere between the first step portion and the junction of the third wall portion and the second wall portion of the overcap.

* * * * *